United States Patent [19]

Hedström

[11] Patent Number: 4,987,971

[45] Date of Patent: Jan. 29, 1991

[54] ARRANGEMENT IN HANGING CRADLES

[76] Inventor: Ture Hedström, Enskiftesvägen 68, 145 60 Norsborg, Sweden

[21] Appl. No.: 324,655

[22] Filed: Mar. 17, 1989

[30] Foreign Application Priority Data

Mar. 17, 1988 [SE] Sweden ..... 8800976
Nov. 22, 1988 [SE] Sweden ..... 8804217

[51] Int. Cl.[5] ..... A01M 31/02; A45F 3/26
[52] U.S. Cl. ..... 182/142; 182/150
[58] Field of Search ..... 182/142, 150, 191

[56] References Cited

U.S. PATENT DOCUMENTS

| | | | |
|---|---|---|---|
| 2,662,734 | 12/1953 | Allenbaugh | 182/142 |
| 2,998,094 | 8/1961 | Fisher | 182/142 |
| 3,464,520 | 9/1969 | Anderson | 182/142 |
| 3,630,315 | 12/1971 | Meyer . | |
| 4,225,012 | 9/1980 | Hindle | 182/142 X |
| 4,602,698 | 7/1986 | Grant | 182/142 |
| 4,650,036 | 3/1987 | Matsuda | 182/142 X |

FOREIGN PATENT DOCUMENTS

| | | | |
|---|---|---|---|
| 975405 | 9/1975 | Canada | 182/150 |

*Primary Examiner*—Karen J. Chotkowski
*Attorney, Agent, or Firm*—Burns, Doane, Swecker & Mathis

[57] ABSTRACT

A hanging cradle arrangement (1) of the kind which comprises a working platform (2), a post or arm (3) which extends upwardly from the platform and which is intended to work with a line (4, 4*a*, 4*b*), a first attachment (5) or pulley located above the working platform (2); a guide (6) or pulley located on the free part (3*a*) of the post (3); normally a second attachment (7) located beneath said guide (6); and device (8) for raising and lowering the working platform by changing the distance between the guide (6) and the first attachment (5) with the aid of a line activating machine (8). According to the invention the arrangement is such that the distance (H) between the platform (2) and the upper free part (3*a*) of the post can be decreased when the upper free part (6) is in co-action with the first attachment (5), and in that the possibility is provided of further raising the working platform.

The post (3) has the form of a rod or a tube which is torsionally rigid in relation to the platform and which is mounted for axial movement in at least two journal devices (11, 12) which are stationary in relation to the working platform (2).

Arranged between the rod (3) and the platform (2) or some other fixed part, is a spring device (14) which holds the rod (3) in a position directed away from the platform (2) and which is compressed when the rod (3) is urged downwords by an externally applied force, the rod again taking an upwardly extending position when the external force is removed.

16 Claims, 1 Drawing Sheet

ARRANGEMENT IN HANGING CRADLES

TECHNICAL FIELD

The present invention relates to improvements in hanging cradles or like stuctures, and then in particular in hanging cradles or like structures of the kind which include a support surface, or working platform, and a single centrally located arm or post extending vertically upwards from the working platform.

Thus, the present invention relates more specifically, but not exclusively, to hanging cradles of the kind which are adapted to work with a single line arrangement or like device and which includes a first attachment means, or pulley, located above the hanging cradle and functioning as a cradle attachment means, a guide means or pulley located on an upper free part of the post, and a second attachment means located beneath the guide means.

Such cradles will also utilize means for raising and lowering the cradle, by changing the distance between said guide and said first attachment or attachment point with the aid of a machine which acts on the line.

BACKGROUND PRIOR ART

Various different hanging cradle constructions of this kind are known to the art, wherein said cradles are constructed to work with a single line means which is intended to pass through a guide mounted on the upper free part of a centrally located arm or post.

Hanging cradles of this kind are often used for working on the external wall surfaces of building structures, and when the cradle is used for this purpose the uppermost part of the line is attached to a holder located adjacent to the roof of the building and the cradle can be raised and lowered along the line, with the aid of a machine intended herefor.

It is also known that such hanging cradles are encumbered with a technical problem, in that the supporting surface or platform of the cradle, which platform is normally horizontal in use, will tip or tilt as soon as the gravitational centre of the cradle and the load carried thereby is shifted to one side of the line.

This shifting of the gravitational centre will take place, for instance, when a person carried by the cradle moves along the platform, from the central region of the cradle to the end or edge regions thereof.

It is also known that tilting of the cradle as a result of a shift in the gravitational centre can be counteracted to some extent by giving the post a considerable length vertically away from the platform, while still allowing the line guide to be placed on the upper free part of the post.

Unfortunately, this solution prevents work from being carried out by a person standing on the platform adjacent to the attachment point and slightly therebeneath, when the cradle is raised to its highest raisable position.

One example of the present state of this art is found described and illustrated in U.S. patent specifications Nos. 3 967 696 and 3 630 315.

It has also been proposed to enable the distance between the working platform and the free part of the post to be decreased when said free post part is in co-action with the attachment. A facility is also provided whereby the cradle can be raised further, for the purpose of reducing the tendency of the cradle to tilt in response to a lateral shift in the centre of gravity.

SUMMARY OF THE PRESENT INVENTION

Technical Problems

When considering the present state of the art as described in the aforegoing, together with the above recited proposals, it will be seen that a qualified technical problem resides in the ability to construct a hanging cradle in a manner such that the ability of the cradle to tilt in response to a lateral shift in the gravitational centre can be reduced with the aid of a long post or arm which extends vertically upwards from the cradle platform, while providing conditions which will enable a person standing on the platform, with the cradle raised to its upper limit, to carry out work in the immediate vicinity of the attachment point and in certain instances also to work in areas located above the attachment point, and in addition to be able to take stabilizing measures when the line is located at a distance from the upwardly extending post.

In the case of a hanging cradle of the aforesaid kind and in the endeavour to arrive at solution to the aforesaid technical problem, it is apparent that a further technical problem will lie in achieving a simple constructive solution to the construction or configuration of the post which will enable the distance between the cradle platform and the upper free part of the post to be shortened when said upper free part co-acts with the first attachment, by further activation of the means normally used to raise the cradle to the location of the first attachment means, and furthermore afford the possibility of utilizing a vertical post which has mounted thereon an upper horizontal projection effective in ensuring that the line will be located within the confines of the platform and preferably within a central region of the platform.

A technically qualified consideration in this regard is that of realizing that in this case the post or arm shall be of simple design and operate in conjunction with simple journal means, and shall be held torsionally rigid adjacent to the platform while affording the desired vertical return movement of the post relative to the platform.

It will also be seen that a technical problem resides in providing conditions which will enable the post to coact readily with a spring device so constructed and arranged as to normally hold the post in an upper extended position, and capable of being compressed by an externally applied force so as to displace the post axially downwards, this axial lowering of the post taking place when the upper free part of the post abuts the upper, fixed attachment and the lifting force is allowed to act on the platform to raise the same, so that the post will again take an upper position when the force ceases with the post being held torsionally rigid to the platform during the whole of this movement.

Another technical problem in the present context is one of providing simple means for achieving this technical effect while simultaneously creating conditions such that the post will be flexurally rigid and assist in stabilizing the tendency of the cradle to swing or tilt laterally when the gravitational centre shifts.

A further technical problem is one of providing a hanging cradle which provides the facility of a long flexurally rigid post and therewith a more stable cradle at high working heights while still enabling work to be carried out adjacent to and above the attachment point when standing solely on the platform.

It will also be seen that a further technical problem resides in the provision of a post or arm which has the form of a straight tube, preferably an aluminium tube, of uniform thickness and which promotes solving the aforesaid problem by being arranged for axial displacement in at least two journals, and also for co-action with one or more simple spring devices which urge the tube against a stop, and with which arrangement the length of tube above the platform can be decreased by downward displacement of the tube, and the cross-sectional shape of the tube is adapted for torsionally rigid connection of the post to the platform.

Solution

The present invention thus relates to an arrangement in lifting cradles of the kind which comprise a platform and a post extending vertically from the platform, and which is intended to co-act with a single line. The arrangement includes a first attachment or pulley locatad above the cradle and a guide or pulley located on the upper free part of the post, and normally a second attachment located beneath the guide. Means are also provided for raising and lowering the cradle, by changing the distance between the guide and the first attachment with the aid of a line activating machine.

It is proposed in accordance with the invention that a hanging cradle of this kind is provided with means which will enable the distance between the platform and the free part of the post to be decreased when the free part co-acts with said first attachment and that a facility is provided whereby the cradle can be raised still further through the agency of standard coupling means, and that the post is torsionally rigid on the platform.

A further characteristic feature of the invention is that the post consists of a rod or tube which is arranged for axial movement in at least two journal devices which are stationary in relation to the platform.

It is also proposed that the rod or tube is arranged to co-act with spring means adapted to hold the rod in an upper raised position.

At least one of the journal devices will preferably comprise an assembly which includes three roller bearings or ball bearings which run against the rod, one of said bearing devices being located above adjacent to bearings.

It is further proposed in accordance with the invention that there is arranged between the rod and the working platform, or some other fixed part, a spring device which is effective in maintaining the rod in a position in which said rod extends away from the platform and which will be compressed when the rod is urged downwards by an externally applied force, wherewith then an uplifting external force is applied the rod will again be upwardly extended to its maximum height or length.

The second attachment will preferably comprise a drive motor located beneath the platform and coupled to one or more line activation wheels such as to raise or lower the cradle, depending on the direction of rotation.

According to one embodiment, the post is located outside the safety guard or handrail on the cradle basket, whereas the guide is loacted on the extremity of a projection which projects inwardly over the guard rail and terminates at or substantially at the natural centre of gravity of the cradle, i.e. when no load is placed thereon.

Preferably two spring devices are used, one on each side of the rod.

ADVANTAGES

The advantages primarily afforded by an arrangement constructed in accordance with the invention reside in the possibility of using a rod or tube of uniform thickness, preferably an aluminium tube, so that the upwardly extending post can be given a considerable length and therewith reduce the tilting tendencies of the hanging cradle when the centre of gravity shifts. A further advantage is afforded by the fact that the inventive arrangement enables a person carried by and standing on the working platform of the cradle to carry out work adjacent to the attachment located above the cradle and even above said attachment, by allowing the rod to run axially through fixed journal devices, and to lower himself readily to the working platform. The invention also affords the advantage of an upper horizontal projection by means of which the line can be located within the central region of the working platform, and therewith requiring a rod cross-section which will enable the rod to be connected to the platform so as to be held torsionally rigid.

The primary characteristic features of an arrangement according to the invention are set forth in the characterizing clause of the following claim 1.

BRIEF DESCRIPTION OF THE DRAWINGS

An embodiment of an arrangement having features significant of the present invention and applied with a hanging cradle adapted to work with a single line will now be described in more detail with reference to the accompanying drawing, in which.

DESCRIPTION OF PREFERRED EMBODIMENTS

Figure 1:
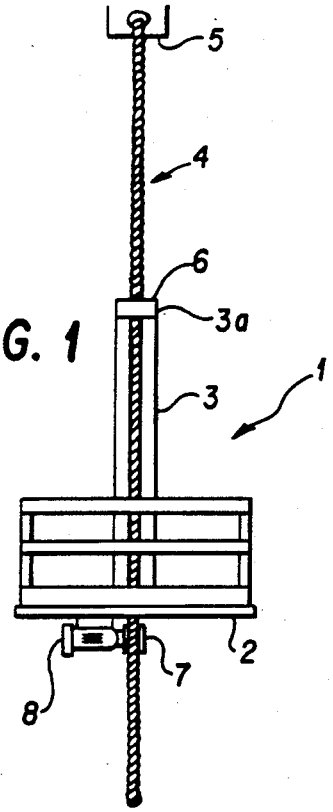
FIG. 1 is a front view of a hanging cradle which works with a single line and in which the centre of gravity is located on and acts in the longitudinal extension of the line.

The present invention relates to an arrangement in hanging cradles, and particularly, but not exclusively, to an arrangement in a hanging cradle 1 which comprises a normally horizontal platform surface 2 and an arm or post 3 which extends upwardly from the platform, said cradle being constructed to work with and hang from a single line 4. The platform 2, or support surface, forms the bottom of a cradle basket, equipped with a handrail or like safety guard.

Located above the cradle 1 is a first attachment or pulley 5 and a guide 6, which may be a pulley. The guide 6 is located on the upper free part 3*a* of the post 3 and a second attachment 7 is located beneath the platform 2 and therewith also beneath the guide 6. The cradle 1 is raised and lowered along the line 4 with the aid of a known device 8 which is effective in changing the length of line 4a extending between the guide 6 and the first attachment, the device in this case having the form of a machine (8) which drives the line and which can be switched to rotate in one direction or the other by switch means not shown. The machine may be an electrical machine.

FIG. 1 illustrates the attitude taken by the cradle 1 when its centre of gravity acts in the direction of the line 4.

Figure 2:
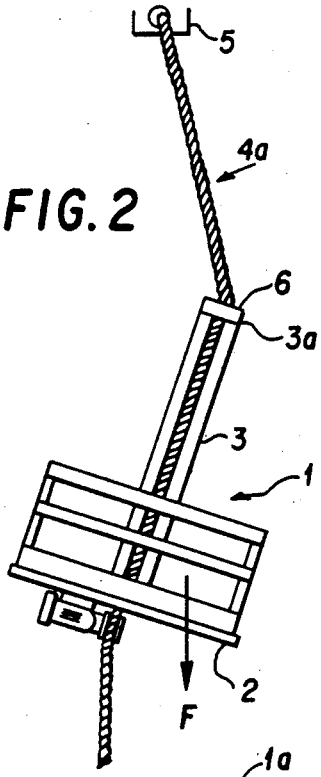
FIG. 2 illustrates tilting of the cradle of FIG. 1 as a result of a shift in the gravitational centre to the right in FIG. 1.

Although the embodiment according to FIGS. 1 and 2 is shown to include a fixed attachment 5, it will be understood that this attachment can be exchanged for a movable traverse or like overhead device which runs along guide means.

It will also be understood that because the cradle 1 hangs from a single line 4, the cradle 1, and therewith the platform 2, will tilt should the centre of gravity of the cradle and the load carried thereby be displaced to one side, e.g. to the right, as in the case illustrated in FIG. 2.

It will be seen from FIG. 2 that the longer the post 3, i.e. the greater the distance between the platform 2 and the guide 6, the smaller the tilting tendency of the cradle 1 for one and the same extent of gravitational centre displacement.

It has also been established that when the centre of gravity is shifted, the instabilty of the cradle 1 will increase with increasing line lengths 4a between guide 6 and attachment 5.

Consequently, the longer the line extension or line part 4a, the greater the need to extend the post 3 upwardly, As before mentioned, the provision of a longer post is not feasible or judicious, since a long extension between the platform 2 and the guide 6 will mean an equally as long distance from the first attachment 5 to the platform 2 when the cradle is raised to its uppermost position and consequently a person standing on the platform 2 will be unable to work comfortably in the vicinity of the attachment 5, unless he supports a stepladder or the like on the platform.

The present invention overcomes this drawback, by enabling the distance "H" (FIG. 3) between the platform 2 and the guide 6 at the upper free part 3a of the post 3 to be reduced when the upper free part 3a of said post is in co-action with the first attachment 5, when normal measures are taken to raise the cradle further. This is effected by causing the machine 8 to raise the platform 2 further.

Figure 3:
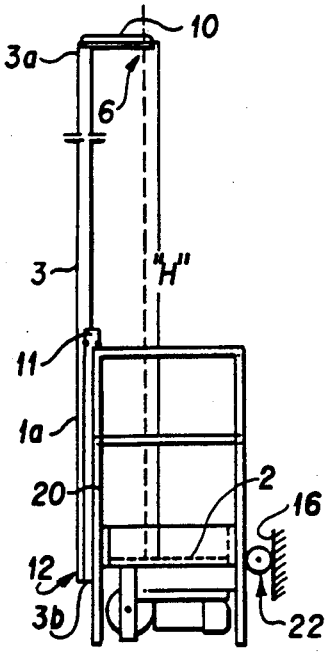
FIG. 3 is a side view, partly in section, of a hanging cradle, and illustrates an arrangement particular to the invention.

In the case of the FIG. 3 embodiment, the post has the form of a rod or tube of uniform thickness. The post may have any desired cross-sectional shape, although the illustrated post has the outer cross-sectional shape shown in FIG. 5.

The post 3 is journalled in two journal devices or journals 11 and 12, of which one device 11 is rigidly attached to the uppermost part of the handrail or like guard 1a and the other device is mounted on the lowermost part of the guard.

The post 3 has on its lowermost part a small projection 36 which will prevent the post from being moved axially upwards to an extent greater than that illustrated in FIG. 3. The post 3 can still be moved downwards, however.

Arranged adjacent to the journal 11 are two spring devices (FIG. 4), which are firmly connected to the uppermost part of the safety guard 1a. These spring devices 13, 14 are postioned on respective sides of the post 3 and are attached to the lower part of the post. (The spring devices are not shown in FIG. 3.)

When the post 3 is force downward, the spring devices are stretched or extended against the accumulation of a spring force and when the force on the post is removed, the spring devices will retract and draw the post upwards, to the position illustrated in FIG. 3.

Each of the spring devices consists of a tension spring of known configuration.

Figure 4:
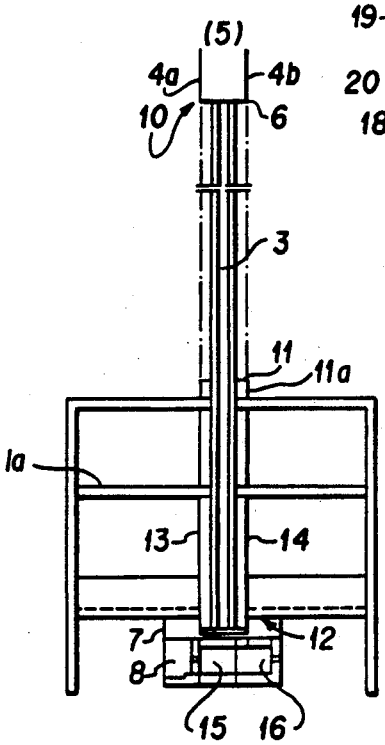
FIG. 4 is a front view of the cradle illustrated in FIG. 3.

The journals 11 and 12 are mutally identical, and it will be seen from FIG. 4 that the journal 11 is attached to the guard or handrail 1a of 11a.

In the case of the embodiment illustrated in FIG. 4, the line 4 is a double-line comprising line runs 4a, 4b each of which co-acts with a respective line pulley 15, 16.

Thus the reference to a single line as used in the present specification does not necessarily mean a line which consists of a single run, but also a line arrangement in which two or more line runs are arranged closely adjacent to one another.

Figure 5:
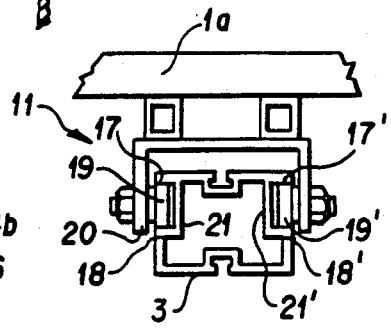
FIG. 5 is a side view in somewhat larger scale of a suitable journal device.

The cross-sectional shape of the post 3 is illustrated in FIG. 5. The post of this embodiment is essentially of rectangular cross-section and consists of an extended aluminium profile.

This profile has two mutually opposing runner surfaces 17, 18 and the distance between the runners is only insignificantly greater than the diameter of a ball bearing 19 mounted on a U-shaped rail 20 in a known manner.

The rail 20 is attached to the guard or handrail in a known manner.

The profile also has a further runner surface 21 against which the peripheral surface of a ball bearing (not shown) located beneath the ball bearing 19 will run.

In a corresponding manner, the profile also presents runner surfaces 17', 18' for a ball bearing 19' and a further runner surface 21' for co-action with the peripheral surface for a further ball bearing (not shown).

The journal device identified generally by 11 in FIG. 5 is identical with the journal 12.

This arrangement of four bearings in the journal device 11 and four bearings in the journal device 12 will enable the post 3 attached to the cradle to be held torsionally rigid while still permitting the post to move up and down in the direction of its long axis.

The post 3 is arranged externally of a guard 1a forming part of the cradle basket, whereas the guide 6 is located on the extremity of a horizontal projection 10 which extends in over the guard and terminates at a point which corresponds or substantially corresponds to the location of the centre of gravity of the cradle when unloaded.

The cradle platform 2 may also have arranged on outer surfaces thereof, on either side of the line 4, support wheels which are intended to lie against the surface of the structure to be worked on with the aid of the cradle. This surface is indicated in FIG. 3 and is referenced 16, and one wheel 22 is also shown in this Figure.

It will be understood that the invention is not limited to the aforedescribed exemplifying embodiment and that modifications can be made within the scope of the following claims.

I claim:

1. A hanging cradle arrangement which comprises: a working platform; a post which extends upwardly from said working platform and which is intended to work with a line; a first attachment for said line located above an upper free part of the post; a guide for said line located on the free part of the post; a second attachment for said line located beneath said guide; and means for raising and lowering the working platform by changing the distance between said guide and said first attachment with the aid of a line activating machine, characterized in that the arrangement includes means for further raising of said working platform such that the distance between said working platform and the upper free part of the post can be decreased when said upper free part of the post is in co-action with said first attachment, and in that the post is in torsionally rigid co-action with the working platform.

2. A hanging cradle arrangement according to claim 1, characterized in that the post has the form of a rod which is arranged for axial movement in at least two journals which are fixed in relation to the working platform.

3. A hanging cradle arrangement according to claim 2, characterized in that the rod is of a tubular shape and made of aluminum.

4. A hanging cradle arrangement according to claim 1, characterized in that arranged between the post and the working platform is a spring device which is effective in holding the post in a position directed away from the working platform and which is compressed when the post is forced to move axially downward by an externally applied force, said post returning to an upwardly extended state when said force is removed.

5. A hanging cradle arrangement according to claim 1, characterized by a resilient element which co-acts with the post in a manner to hold said post in an upper position.

6. A hanging cradle arrangement according to claim 2, characterized in that at least one of said journals comprises an assembly which includes a plurality of one of roller bearings and ball bearings which run against the rod.

7. A hanging cradle arrangement according to claim 6, characterized in that one of the bearings is located in above, adjacent relation to another of the bearings.

8. A hanging cradle arrangement according to claim 1, characterized in that the second attachment includes said line activating machine and comprises a drive motor which is mounted beneath the working platform and one or more line activation wheels coupled to said drive motor which activate said line so as to either raise or lower the working platform, depending on the direction of rotation.

9. A hanging cradle arrangement according to claim 1, characterized in that the post is positioned adjacent to a safety guard rail on the hanging cradle arrangement and the guide is located on the extremity of a projection which extends in over the guard rail and terminates at a point which substantially coincides with the centre of gravity line of the hanging cradle arrangement when no load acts thereon.

10. A hanging cradle arrangement according to claim 4, characterized in that said hanging cradle arrangement includes two spring devices, one on each side of the post.

11. A hanging cradle arrangement according to claim 2, characterized in that arranged between the post and the working platform is a spring device which is effective in holding the post in a position directed away from the working platform and which is compressed when the post is forced to move axially downward by an externally applied force, said post returning to an upwardly extended state when said force is removed.

12. A hanging cradle arrangement according to claim 3, characterized in that arranged between the post and the working platform is a spring device which is effective in holding the post in a position directed away from the working platform and which is compressed when the post is forced to move axially downward by an externally applied force, said post returning to an upwardly extended state when said force is removed.

13. A hanging cradle arrangement according to claim 2, characterized by a resilient element which co-acts with the rod in a manner to hold said rod in an upper position.

14. A hanging cradle arrangement according to claim 11, characterized in that said hanging cradle arrangement includes two spring devices, one on each side of the rod.

15. A hanging cradle arrangement according to claim 12, characterized in that said hanging cradle arrangement includes two spring devices, one on each side of the rod.

16. A hanging cradle arrangement according to claim 1, wherein said first attachment is a pulley.

* * * * *